US008979422B2

(12) United States Patent
Künze et al.

(10) Patent No.: US 8,979,422 B2
(45) Date of Patent: Mar. 17, 2015

(54) COVER HAVING A WEAR-RESISTANT SURFACE AND METHOD FOR THE PRODUCTION THEREOF

(75) Inventors: Manfred Künze, Dornburg (DE); Stefan Weis, Hadamar (DE); Peter Merkl, Limburg (DE)

(73) Assignee: MeierGuss Limburg GmbH, Limburg (DE)

( * ) Notice: Subject to any disclaimer, the term of this patent is extended or adjusted under 35 U.S.C. 154(b) by 0 days.

(21) Appl. No.: 13/501,579

(22) PCT Filed: Oct. 12, 2010

(86) PCT No.: PCT/EP2010/065293

§ 371 (c)(1),
(2), (4) Date: Jun. 21, 2012

(87) PCT Pub. No.: WO2011/004527

PCT Pub. Date: Apr. 21, 2011

(65) Prior Publication Data

US 2012/0263527 A1 Oct. 18, 2012

(30) Foreign Application Priority Data

Oct. 13, 2009 (DE) ..... 10 2009 049 288

(51) Int. Cl.
*E02D 29/14* (2006.01)
*B22D 15/00* (2006.01)
*B22D 27/18* (2006.01)

(52) U.S. Cl.
CPC ..... *E02D 29/14* (2013.01); *B22D 15/00* (2013.01); *B22D 27/18* (2013.01)
USPC ..... 404/25; 404/72

(58) Field of Classification Search
USPC ..... 404/25, 72; 137/371
See application file for complete search history.

(56) References Cited

U.S. PATENT DOCUMENTS

| | | | | |
|---|---|---|---|---|
| 1,517,871 A | | 12/1924 | Thompson | |
| 1,799,489 A | * | 4/1931 | West | 404/25 |
| 2,004,335 A | | 6/1935 | Merriman | |
| 2,250,489 A | | 7/1941 | Lorig et al. | |
| 2,456,517 A | | 3/1951 | Norman | |
| 3,289,556 A | * | 12/1966 | Russell | 404/25 |

(Continued)

FOREIGN PATENT DOCUMENTS

| | | |
|---|---|---|
| DE | 742605 | 5/1943 |
| DE | 24 40 452 | 8/1974 |

(Continued)

OTHER PUBLICATIONS

Translation of Japan Patent 56-98416.*

(Continued)

*Primary Examiner* — Gary Hartmann
(74) *Attorney, Agent, or Firm* — Clark & Brody

(57) ABSTRACT

The invention relates to a cast-iron cover fitted with at least one traffic-bearing surface which in turn comprises at least segment-wise a wear-resistant layer constituted by chilling the cast iron. Preferably the wear-resistant layer exhibits a Brinell hardness larger than 275 HBW but less than 350 HBW. A method of the invention furthermore relates to manufacturing a cast-iron cover, first manufacturing a shaped body. Then an activation layer is made within the shaped body. Cast iron is poured-in in a way to be at least partly chilled at a contact surface with the activation layer.

10 Claims, 3 Drawing Sheets

(56) References Cited

U.S. PATENT DOCUMENTS

| | | | | | |
|---|---|---|---|---|---|
| 3,455,059 | A | * | 7/1969 | Evans | 49/397 |
| 4,003,425 | A | | 1/1977 | Middleton | |
| 4,013,374 | A | * | 3/1977 | Weiler et al. | 404/25 |
| 4,499,695 | A | * | 2/1985 | Oger et al. | 52/19 |
| 4,751,799 | A | * | 6/1988 | Ditcher et al. | 52/21 |
| 5,066,546 | A | * | 11/1991 | Materkowski | 428/627 |
| 6,000,878 | A | * | 12/1999 | Takada et al. | 404/25 |
| 6,302,318 | B1 | * | 10/2001 | Hasz et al. | 228/254 |
| 8,118,517 | B2 | * | 2/2012 | Kelley et al. | 404/25 |

FOREIGN PATENT DOCUMENTS

| | | | |
|---|---|---|---|
| DE | 100 49 598 | | 4/2002 |
| GB | 2 475 403 | * | 11/2010 |
| JP | 56-98416 | * | 8/1981 |

OTHER PUBLICATIONS

XP-002632224 Nach Harte konziptierte Sorten, 2009 http://www.sn-castiron.de/gusseisen/nach_harte_sorten.

* cited by examiner

COVER HAVING A WEAR-RESISTANT SURFACE AND METHOD FOR THE PRODUCTION THEREOF

FIELD OF THE INVENTION

Background Art

The present invention relates to a cast-iron cover fitted with at least one abrasion-resistant surface as defined in the preamble of claim 1 and to a method for manufacturing such a cover.

Covers, caps/gratings, other objects used in spot or linear water sprinkling as well as tree-protecting gratings respectively tree-protecting systems have long been used in street/road construction. Preferably such components are made of cast iron since such covers may be subjected to high traffic loads.

For safety reasons, such covers also must be anti-skidding. One way to attain the required skid resistance is controlling the surface roughness using composite materials. Accordingly the cover's top side is coated with a resin-bonded or concrete-bonded granulate. Preparing such covers is costly because casting them must be followed by further finishing procedures.

SUMMARY OF THE INVENTION

The covers of the state of the art incur frequently the drawback of short surface life. Vehicles or pedestrians moving over them significantly abrade them, thus jeopardizing traffic safety.

Accordingly it is the purpose of the present invention to create a cover which is fitted with a traffic-bearing respectively contact surface that shall be resistant to the said abrading loads. This invention also shall be economical and easily implemented.

As regards a cast-iron cover comprising at least one abrasion-exposed surface, the invention stipulates that said abrasion-exposed surface is fitted at least segment-wise with a wear-resistant layer and that said wear-resistant layer constituted in part by white solidification of the cast iron.

The cover of the invention applies equally well to a manhole, an intake grating, a cap for street/road intakes of a tree protecting system. By forming a comparatively thin wear-resistant layer constituted by a white solidified cast iron, the service life of such covers may be extended considerably. The solidification of iron carbon alloys by means of the metastable system assures that the wear-resistant layer shall be harder than the remaining cast iron which is solidified cast gray iron.

Nor need all of the abrasion-exposed surface be made of white solidified cast iron. Instead only part of said surface need consist of white solidified cast iron. Mixed cast iron containing white solidified and gray solidified iron zones next to each other is, just as applicable.

Formation of a white solidified structure zone (chill depth) assures that the cover of the invention as a result shall better withstand the abrasive stresses than a conventional cast iron cover. Such a cover of the invention moreover can be made more economically. Nor is the abrasion-exposed surface mandatorily situated at the cover's top side. Illustratively the contact area with the frame also is exposed to higher abrasive loads.

In a particularly advantageous design of the invention, the Brinell hardness of the wear-resistant layer shall be larger than 275 HBW and less than 350 HBW. Surface abrasion is already precluded optimally within this range of hardnesses.

If the hardness exceeds 350 HBW, the wear-resistant layer becomes brittle. Impulsive loads then gradually destroy said layer, degrading the entire cover.

In a further feature of the invention, the traffic surface is fitted with a skid-inhibiting means created by a fine cast iron structure. As a result, in combination with the said chilled wear-resistant layer, the surface roughness can be created directly during the casting procedure. The structure so attained is well protected against abrasion at the cast iron surface and even years of use later provides skid inhibition at the cover's surface.

In the ideal case, said structure is characterized by a fluting height of 2 to 8 mm. When a cover is fitted with such a preferred fluting height, the entire structure may be made of chilled cast iron. In this manner the cover's service life is extended even further.

A method of the invention to manufacture a cast iron cover includes the following stages:

1. Making a shaped body for said cover,
2. Making an activation layer within the shaped body,
3. Filling-in cast iron in a manner it is chilled at least partly at the activation layer's contact surface.

The method of the invention meets the criteria to create a cover constituted solely of cast iron and being fitted at its traffic surface respectively at the contact surface between the cover and the frame with a durable, abrasion-resistant wear-resistant layer.

For that purpose, and in a first stage, a shaped body is made and frequently is constituted of clay-bonded molding sand. The molding sand's main components are quartz sand, casting clays, various carbon carriers and water. Using an appropriate model enclosed by a frame, namely the so-called bottom box, the molding sand is compacted into a casting-ready mold and in this manner it constitutes the shaped body.

Next an activation layer is constituted within the shaped body that then is filled with the casting iron which shall chill at its contact surface with the activation layer. Said white solidification does not take place through all of the cast component, but only at its surface facing the activation layer. In the process the wear-resistant structural components such as iron carbide or ledeburite are constituted as crystals in the cast iron. Thereupon this layer may serve as the wear-resistant layer, its thickness ideally being up to 5 mm. The wear-resistant layer so made is hard enough to withstand for many years the stresses of daily traffic.

Illustratively the activation layer may be made of chemical elements or chemical compounds assuring the crystalline formation of iron carbide, ledeburite or other wear-resistant structural components at the casting iron's contact surface. Tellurium for instance is such a chemical element. This design of the invention makes possible a uniform activation layer surface. The particles of the chemical compounds can be distributed arbitrarily within the mold.

In especially preferred manner, the chemical elements resp. chemical compounds are introduced into the mold by laying, spraying, soaking, padding or strewing. In this way nearly all suitable chemical compounds and chemical elements are easily applied to the mold. As a result, the activation layer can be matched to every surface of the shaped body. Therefore the method of the invention also allows making complex geometry covers.

Another and equally advantageous embodiment mode of the invention stipulates that the activation layer be constituted in the shaped body by means of inserted cooling elements or inserted chilling elements. The white solidification also may be carried out by rapidly cooling the filled-up cast iron. Rapid cooling at the activation layer is implemented by the cooling or chilling elements, again resulting in a white solidification. This procedure offers the advantage of circumventing the use of expensive chemicals such as tellurium. Moreover, preparing the mold sand is simplified and hence more economical because no chemical residues need be removed from it.

The shaped body preferably is set up in a molding box consisting of an upper box and a lower box. To constitute the shaped body, the upper and lower boxes are filled separately from each other with molding sand. In the next operational step a ramming cap moves over the upper box respectively the lower box and compacts the molding sand into a hard, casting-ready shaped-body half. Thereupon the upper and lower boxes are superposed and secured by a locking means against upward forces during casting. Now the shaped body shall be ready for casting in the closed molding box.

Following casting the halves can be easily separated and the blank can be removed.

In advantageous manner, the activation layer may be constituted in the shaped body at either of the shaped body halves. During this procedural stage, the upper and lower boxes are not yet connected to each other.

Preparing the activation layer in this manner offers the advantage that the shaped body halves fitted with the activation layer may be checked directly for defects. Accordingly costly casting defects are averted and the manufacture of the activation layer is simplified.

BRIEF DESCRIPTION OF THE DRAWINGS

Further features, particulars and advantages of the invention are defined in the claims and are implicit and/or explicitly stated in the description below of illustrative embodiment modes in relation to the appended drawings.

DETAILED DESCRIPTION OF THE INVENTION

Figure 1:
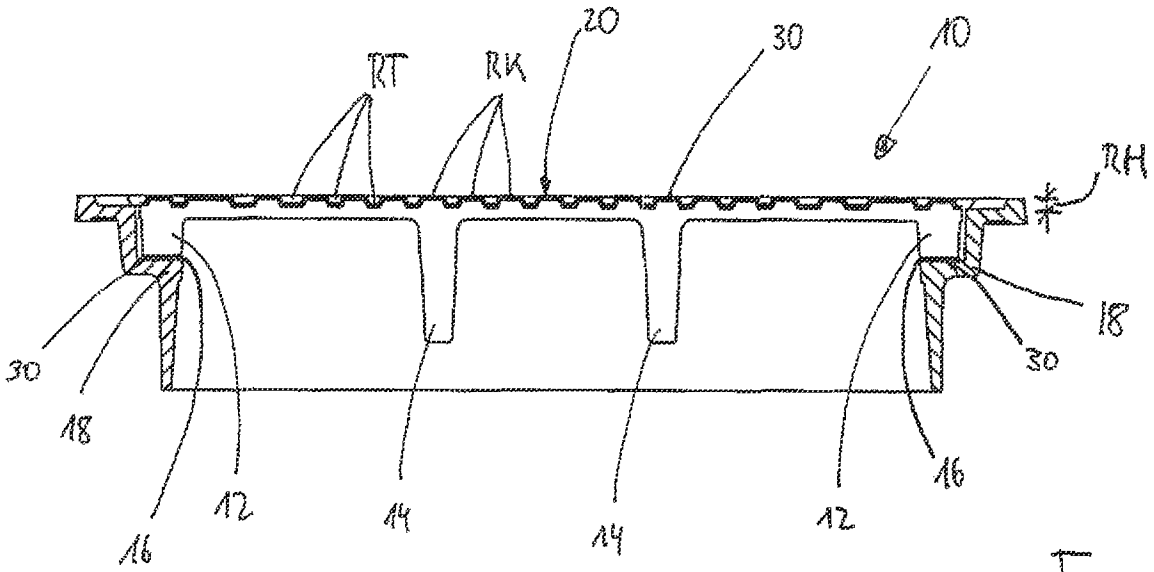
FIG. 1 shows a cover fitted with a continuous wear-resistant coating.

FIG. 1 shows a cover 10 of the invention fitted with the associated frame 18. A wear-resistant layer 30 is constituted at the traffic surface 20. However the wear-resistant layer 30 does not run through the full thickness of the cover. The rim supports 12 and the ribs 14 of the cover 10 also are coated only at their top side with a constant, thin wear-resistant layer 30. Also, the thickness of the white solidified ear-resistant layer 30 is approximately constant across the full top surface. This feature also applies equally for both the zones of the fluting troughs RT and the zones of the fluting peaks RK. The fluting height RH subtended between the fluting trough RT and the fluting peak RK does not affect the thickness of the wear-resistant layer 30. FIG. 1 also shows the feasibility of constituting a wear-resistant layer 30 at said cover's contact surface 16 touching the frame 18.

Figure 2:
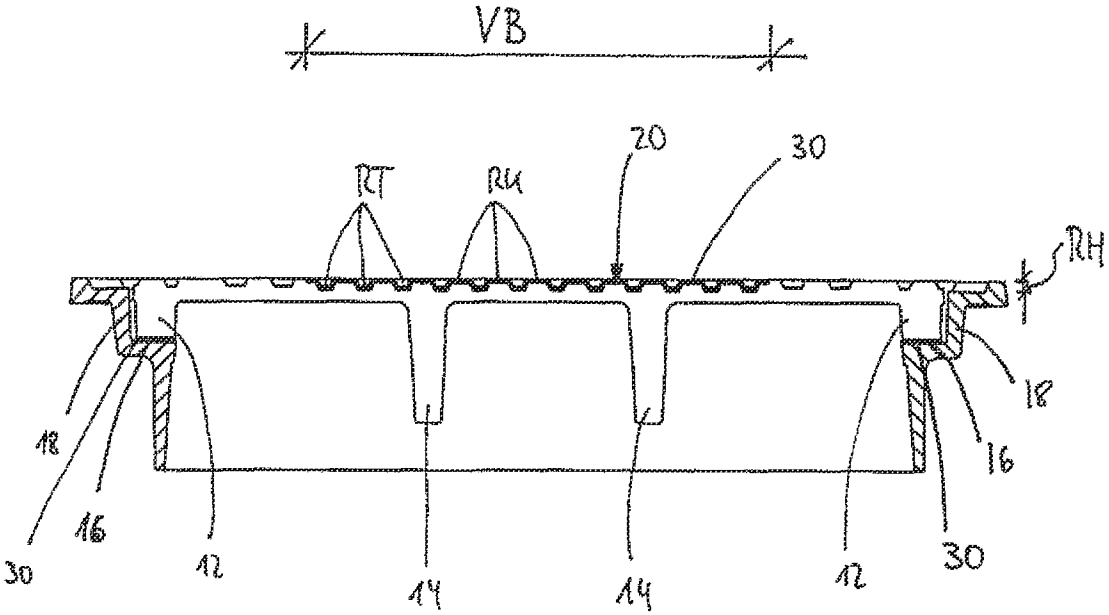
FIG. 2 shows a cover fitted with a wear-resistant zone.

FIG. 2 shows a similar embodiment mode of the invention. This design merely differs from that of FIG. 1 in that the wear-resistant layer 30 is constituted in a wear-exposed zone VB. As a result, the costly manufacture of the wear-resistant layer 30 is eliminated in zones experiencing lesser abrasions. In this embodiment mode too, the support zones (contact surfaces 16) of the cover 10 are fitted with a wear-resistant layer 30.

Figure 3:
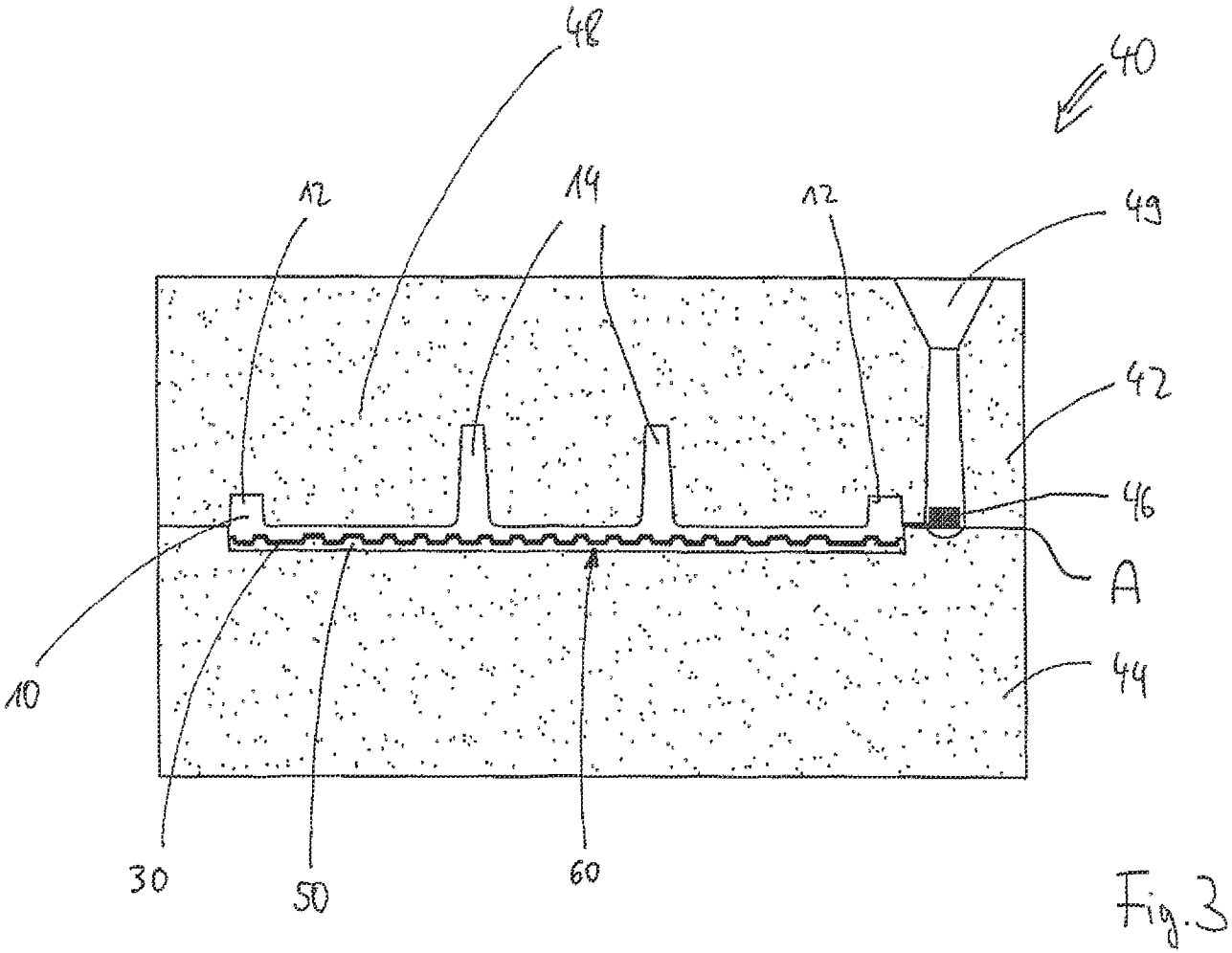
FIG. 3 shows a cover of the invention within the molding box.

FIG. 3 shows a cover 10 of the invention while still in the molding box 40. The cover 10 together with the wear-resistant layer 30 rests in the lower box 42. The rim supports 12 as well as the ribs 14 run as far as into the upper box 42. By means of its molding sand 48, the molding box 40 encloses the entire cover 10. An activation layer 50 is constituted in the lower box 44. The wear resistant layer 30 of the ulterior traffic surface was solidified by chilling at the contact surface 60 of the activation layer 50. By means of an input funnel 49 and a runner and gate system 46, the cast iron enters the shaped body. Following cast iron solidification, the upper box 42 and lower box 44 can be separated from each other along the model parting axis A. The cover 10 now may be removed from the mold box 40.

The invention is not restricted to one of the above described embodiment modes, but may be modified in many ways. Illustratively the upper and lower casting boxes may be interchanged during the casting procedure. Again, the position of the activation layer may be varied.

All features and advantages implicit in and explicit from the claims, description and drawing, inclusive design details, spatial configurations and procedural steps, may be inventive both per se as in arbitrary combinations.

LIST OF REFERENCES

10 cover
12 rim support
14 ribs
16 contact surface
18 frame
20 traffic surface
30 wear-resistant layer
40 molding box
42 upper box
44 lower box
46 runner and gate system
48 molding sand
49 casting input funnel
50 activation layer
60 contact surface
RT fluting trough
RK fluting peak
RH fluting height
VB wear-resistant zone
A model parting axis

The invention claimed is:

1. A cast-iron cover comprising at least one abrasion-exposed surface (20, 16) and a remaining surface to form an overall surface of the cast-iron cover, wherein the at least one abrasion exposed surface (20, 16) has a wear-resistant surface layer (30) on at least a portion of the at least one abrasion exposed surface, the wear-resistant surface layer comprises white solidified cast iron and a remaining surface of the cast-iron cover is solidified gray cast iron, the wear-resistant surface layer (30) being harder than the solidified gray cast iron at the remaining surface of the cast-iron cover, and wherein the wear-resistant surface layer (30) comprises a fluted structure in the white solidified cast iron for skid inhibition, the fluted structure having a fluting height of 2 to 8 mm.

2. The cover (10) as claimed in claim 1, characterized in that the wear-resistant surface layer (30) exhibits a Brinell hardness larger than 275 HBW.

3. A method for manufacturing a cast-iron cover comprising the following steps:

I. manufacturing a shaped body for the making the cover (10);

II. providing an activation layer (50) within the shaped body;

III. filling up the shaped body containing the activation layer (50) with cast iron form the cast-iron cover, contact of the cast iron with the activation layer forming a white solidified cast iron in a portion of a surface of the cast-iron cover as a wear resistant structural component, with a remaining surface portion of the cast-iron cover formed as a gray solidified cast iron.

4. The method as claimed in claim 3, characterized in that the activation layer (50) is prepared from chemical elements or chemical compounds which assure the crystalline formation of the wear-resistant structural component.

5. The method as claimed in claim 4, characterized in that the chemical elements or chemical compounds are deposited in the shaped body by being laid in the shaped body, spraying, soaking, pad application or strewing.

6. The method as claimed in claim 4, characterized in that the activation layer (50) is constituted at least in part in the shaped body by inserted cooling elements or inserted chilling elements.

7. The method as claimed in claim 4, characterized in that the shaped body is constituted in a molding box (40) comprising an upper box (42) and a lower box (44).

8. The method as claimed in claim 4, characterized in that the activation layer (50) is constituted at one half of the shaped body.

9. The cover (10) as claimed in claim 2, characterized in that the wear-resistant layer (30) exhibits a Brinell hardness less than 350 HBW.

10. The method as claimed in claim 4, wherein the wear-resistant structural component is iron carbide or ledeburite.

* * * * *